US005904166A

United States Patent [19]

Nannt et al.

[11] Patent Number: 5,904,166

[45] Date of Patent: May 18, 1999

[54] SPRAY ARM SUPPORT FOR FRONT-LOADING DISHWASHERS

[75] Inventors: Hans-Peter Nannt, Dettingen; Claus Köther, Niederstotzingen, both of Germany

[73] Assignee: BSH Bosch und Siemens Hausgeraete GmbH, Munich, Germany

[21] Appl. No.: 08/832,439

[22] Filed: Apr. 3, 1997

[30] Foreign Application Priority Data

Oct. 17, 1996 [DE] Germany ..... 196 42 9110

[51] Int. Cl.[6] ..... B08B 3/02

[52] U.S. Cl. ..... 134/179; 134/180; 239/264; 239/265

[58] Field of Search ..... 134/56 D, 57 D, 134/58 D, 176, 179, 180, 200, 201, 175, 177, 178; 239/251, 264, 265

[56] References Cited

U.S. PATENT DOCUMENTS

| | | | |
|---|---|---|---|
| 1,675,192 | 6/1928 | Murdoch | 134/176 |
| 2,218,686 | 10/1940 | Showers | 134/179 |
| 3,267,944 | 8/1966 | Meeker et al. | 134/179 |
| 3,538,927 | 11/1970 | Wallgren | 134/180 |
| 3,951,684 | 4/1976 | Laprad et al. | 134/176 |
| 4,064,887 | 12/1977 | Geriger et al. | 134/177 |
| 4,179,307 | 12/1979 | Cau et al. | 134/58 D |
| 4,301,822 | 11/1981 | Dingler | 134/176 |
| 4,418,868 | 12/1983 | Gurubatham et al. | 134/179 |
| 5,546,968 | 8/1996 | Jeon et al. | 134/180 |
| 5,662,744 | 9/1997 | Tuller et al. | 134/179 |

FOREIGN PATENT DOCUMENTS

| | | | |
|---|---|---|---|
| 657763 | 2/1963 | Canada | 134/176 |
| 1454977 | 10/1966 | France | 134/176 |
| 1428499 | 11/1963 | Germany | 134/179 |
| 4-269934 | 9/1992 | Japan | 134/57 D |
| 4-279138 | 10/1992 | Japan | 134/56 D |
| 234455 | 11/1925 | United Kingdom | 134/176 |
| 1113514 | 5/1958 | United Kingdom | 134/176 |

OTHER PUBLICATIONS 509,251 European Patent Application'251, Oct. 1992.

*Primary Examiner*—Frankie L. Stinson
*Attorney, Agent, or Firm*—Herbert L. Lerner; Laurence A. Greenberg

[57] ABSTRACT

A front-loading dishwasher includes at least one basket movable out of the machine toward the front. At least one spray arm is rotatably disposed below the basket, has spray nozzles aimed at the basket and is supported on a fluid supply line that extends from one wall of the machine and is connected to a recirculating pump. A portion of the fluid supply line protruding approximately horizontally into a tub in the region of the bottom of the basket ends in a 90° elbow with an outlet stub pointing downward. The spray arm rests with two wall portions located at different horizontal levels on bearing points of the elbow, which creates a simple spray arm support, in which bearing friction is substantially avoided.

6 Claims, 1 Drawing Sheet

SPRAY ARM SUPPORT FOR FRONT-LOADING DISHWASHERS

BACKGROUND OF THE INVENTION

FIELD OF THE INVENTION

The invention relates to a spray arm support in front-loading dishwashers including at least one basket movable out of the machine at the front and including at least one spray arm rotatably disposed below the basket, having spray nozzles aimed at the basket and being supported on a fluid supply line extending from one wall of the machine and connected to a recirculating pump, a portion of the fluid supply line protruding approximately horizontally into a tub in the region of a bottom of the basket ends in a 90° elbow with an outlet stub pointing downward.

A dishwasher with a spray arm support of the type referred to at the outset is known from German Patent DE 37 02 828.

However, in that kind of downward-hanging configuration of a spray arm, due to the static and dynamic pressure of the dishwashing fluid involved and due to the weight of the spray arm and the dishwashing fluid located in the spray arm, increased bearing friction is generated, which prevents both the startup and the rotation of the spray arm, thus making for less effective dishwashing. It can also cause damage to the bearing points and can either hinder rotation or even completely block the spray arm.

SUMMARY OF THE INVENTION

It is accordingly an object of the invention to provide a spray arm support for front-loading dishwashers, which overcomes the hereinafore-mentioned disadvantages of the heretofore-known devices of this general type and in which bearing friction is substantially avoided.

With the foregoing and other objects in view there is provided, in accordance with the invention, in a front-loading dishwasher including walls, a front, a tub and at least one basket having a bottom and being movable out of the dishwasher toward the front, a spray arm and support assembly, comprising a fluid supply line extending from one of the walls and being connected to a recirculating pump, the fluid supply line having a portion protruding approximately horizontally into the tub in the vicinity of the basket bottom, the portion ending in a 90° elbow, and the elbow having an outlet stub pointing downward and bearing points; and at least one spray arm supported on the fluid supply line, rotatably disposed below the basket, having spray nozzles aimed at the basket and having two wall portions disposed at different horizontal levels and resting on the bearing points of the elbow.

It has been found in practice that the force exerted by the static pressure of the dishwashing fluid generates the predominant portion of the bearing friction. According to the invention, at a second bearing point a counterforce is now generated, which substantially cancels out the forces that cause the bearing friction or in other words the force generated by the static pressure. With the invention, a spray arm support of the type referred to at the outset is thus created in a simple way in which the bearing friction is essentially avoided.

In accordance with another feature of the invention, the wall portions of the spray arm located at different horizontal levels are upper and lower walls of the hollow-body spray arm, which are provided with bearing surfaces for the bearing points of the elbow, so that by using parts that are already present anyway, less engineering and manufacturing effort is involved.

In accordance with a further feature of the invention, the approximately circular-annular bearing surfaces and the approximately equal-sized respectively associated bearing points have different effective bearing diameters from the other bearing surfaces and their approximately equal-sized respectively associated bearing points, so that it is possible to adjust the counter force.

In accordance with an added feature of the invention, the upper bearing surface has a larger effective bearing diameter than the bearing surface located below it, and as a result the counter force can be adapted in such a way that a fluid-tight contact of the spray arm with one of the two bearing points is attained, and additional sealing provisions are unnecessary.

In accordance with an additional feature of the invention, there is provided a bearing part that has the bearing points and is inserted into the outlet stub of the elbow. Due to the thus-attained lengthening of the elbow, this feature simplifies the engineering effort needed for accommodating the bearing points of the invention and simplifies the effort for assembly.

In accordance with yet another feature of the invention, the bearing part is guided in a receptacle that includes two half shells and has the bearing surfaces, thus further simplifying the effort for assembly.

In accordance with yet a further feature of the invention, the receptacle is placed in the spray arm, thus further simplifying the engineering and manufacturing effort.

In accordance with a concomitant feature of the invention, the bearing part can be connected to the 90° elbow through the use of a bayonet mount, which leads to further simplification of the assembly.

Other features which are considered as characteristic for the invention are set forth in the appended claims.

Although the invention is illustrated and described herein as embodied in a spray arm support for front-loading dishwashers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
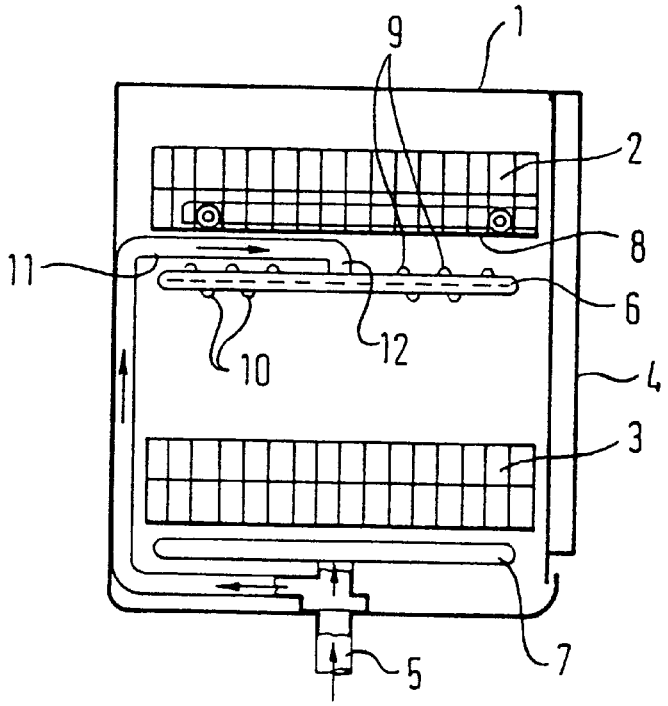
FIG. 1 is a diagrammatic, longitudinal-sectional view of a dishwasher.

Referring now to the figures of the drawings in detail and first, particularly, to FIG. 1 thereof, there is seen a tub 1 of a dishwasher which is accessible for loading and unloading an upper and a lower basket 2, 3 through a door 4 disposed at the front. In the exemplary embodiment, dishwashing fluid for washing dishes is pumped by a non-illustrated recirculating pump through a riser pipe 5 to two rotatable spray arms 6, 7 that are each disposed beneath a respective basket 2, 3. The spray arm 6 which is provided below a bottom 8 of the upper basket 2 has spray nozzles 9 and 10 respectively aimed at the upper basket 2 and the lower basket 3. A portion of a fluid supply line 11 which protrudes into the tub 1 approximately horizontally in the region of the bottom 8 of the upper basket 2 and leads to the spray arm 6, ends in a 90° elbow 12.

Figure 2:
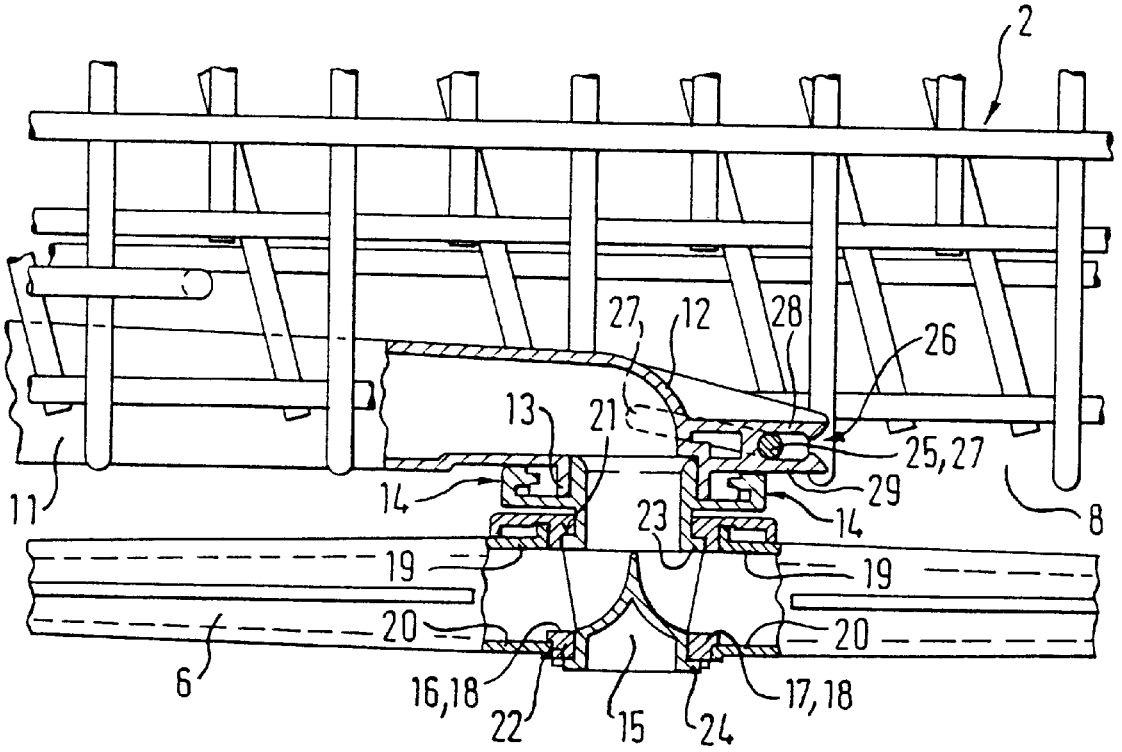
FIG. 2 is an enlarged, fragmentary, sectional view of a spray arm support according to the invention for an upper spray arm.

In the illustrated exemplary embodiment of the invention shown in FIG. 2, the elbow 12 is lengthened by a bearing part 15 that protrudes into an outlet stub 13 of the elbow 12 and is secured to it through the use of a bayonet mount 14, which is located on the outside on both sides. This bearing part 15 is guided in a receptacle 18 that includes two half shells 16, 17 and is placed in the spray arm 6.

According to the invention, the spray arm 6 has two wall portions located at different horizontal levels that rest on bearing points of the elbow 12. In the illustrated exemplary embodiment of the invention, these wall portions of the spray arm 6 that are located at different horizontal levels are an upper wall 19 and a lower wall 20 of the hollow-body spray arm 6, in the region of which respective bearing surfaces 21, 22 of the receptacle 18 are disposed. In the installed position, the bearing part 15 has bearing points 23, 24 that rest on these bearing surfaces 21, 22.

It has been found in practice that a force exerted by the static pressure of the dishwashing fluid generates the predominant portion of the bearing friction. According to the invention, at the lower bearing point 24, due to the static pressure of the dishwashing fluid, a counterforce is now generated, which substantially cancels out the forces that cause the bearing friction or in other words the force generated by the static pressure. According to the invention, a spray arm support is thus created in a simple way in which the bearing friction is essentially avoided.

In the illustrated exemplary embodiment of the invention, the approximately circular-annular bearing surface 21 and the approximately equal-sized associated bearing point 23 have different effective bearing diameters as compared with the other bearing surface 22 and its approximately equal-sized associated bearing point 24. The upper bearing surface 21 and the associated bearing point 23 have a larger effective bearing diameter than the bearing surface 22 and its associated bearing point 24 located below it. Thus the counterforce generated at the lower bearing point 24 by the static pressure of the dishwashing fluid is adapted in such a way that a fluid-tight contact of the spray arm 6 with the upper bearing point 22 is attained. Therefore, additional sealing positions become unnecessary. If both effective bearing diameters are of equal size, then the force generated by the static pressure of the dishwashing fluid is canceled entirely by the counterforce generated at the lower bearing point 24, and as a result the spray arm 6 is held in a suspended state, which on one hand substantially entirely cancels out the bearing friction but on the other hand leads in particular at the upper bearing point 22 to an escape of dishwashing fluid.

In the illustrated exemplary embodiment of the invention, the spray arm 6 is supported mechanically independently from the upper basket 2 on the fluid supply line 11 that extends from one wall of the machine, that is the back wall of the tub 1, and is braced and guided on the basket bottom 8. To that end, as in German Published, Non-Prosecuted Patent Application DE 43 41 682 A1, a mount 25 is provided on the basket bottom 8, and a catch device 26 of the fluid supply line 11 that is disposed on the free end of the fluid supply line 11 is caught on this mount. As a result, the fluid supply line 11 is engaged and guided only when the basket 2 has been inserted into its final position. If the basket 2 is partially pulled out, the fluid supply line 11 protrudes freely into the tub 1, unaffected by the basket. The mount 25 includes a basket wire 27 disposed horizontally in the region of the basket bottom 8 and substantially crosswise to the direction of basket insertion. The catch device 26 has two horizontal carriers 28, 29 spaced apart by a distance that is equivalent to at least the thickness of the basket wire 27 of the mount 25. The carriers 28, 29 are constructed on their free ends with thickenings that protrude into the spacing between them, in the manner of a snap connection. The fluid supply line 11 is thus engaged and guided in the region of a pivot axis of the spray arm 6.

When the above-described configuration of the exemplary embodiment of the invention is assembled, first the bearing part 15 is placed in the half-shells 16, 17 of the receptacle 18, and this structural unit is then placed in the spray arm 6. The spray arm 6 can then be secured to the 90° elbow 12 of the fluid supply line 11 through the use of the bayonet mount 14.

We claim:

1. In a front-loading dishwasher including walls, a front, a tub and at least one basket having a bottom and being movable out of the dishwasher toward the front, a spray arm and support assembly, comprising:

a fluid supply line extending from one of the walls, said fluid supply line having a portion protruding approximately horizontally into the tub in the vicinity of the basket bottom, said portion ending in a 90° elbow, and said elbow having an outlet stub pointing downward and an approximately circular-annular upper and an approximately circular-annular lower bearing point, said upper and lower bearing points disposed at two different horizontal levels; and at least one spray arm supported on said fluid supply line, rotatably disposed below the basket, having spray nozzles aimed at the basket and having a hollow body with an upper and a lower wall disposed at different horizontal levels and resting on said bearing points of said elbow, said upper and said lower wall having an approximately circular-annular upper and an approximately circular-annular lower bearing surface associated to said upper and said lower bearing point of said elbow, respectively, and said upper bearing surface and said associated upper bearing point having a larger effective bearing diameter than said lower bearing surface and said associated lower bearing point.

2. The spray arm and support assembly according to claim 1, including a bearing part inserted into said outlet stub and having said bearing points.

3. The spray arm and support assembly according to claim 2, including a receptacle in which said bearing part is guided, said receptacle including two half shells and said bearing surfaces.

4. The spray arm and support assembly according to claim 3, wherein said receptacle is placed in said spray arm.

5. The spray arm and support assembly according to claim 2, including a bayonet mount for connecting said bearing part to said 90° elbow.

6. In a front-loading dishwasher including walls, a front, a tub and at least one basket having a bottom and being movable out of the dishwasher toward the front, a spray arm and support assembly, comprising:

a fluid supply line extending from one of the walls, said fluid supply line having a portion protruding approximately horizontally into the tub in the vicinity of the basket bottom, said portion ending in a 90° elbow, and said elbow having an outlet stub pointing downward;

at least one spray arm supported on said fluid supply line, rotatably disposed below the basket, having spray nozzles aimed at the basket and having a hollow body with an upper and a lower wall disposed at two different horizontal levels;

a receptacle including two half shells, said receptable placed in said at least one spray arm and having a upper and a lower bearing surface disposed at two different horizontal levels; and a bearing part guided in said receptable and inserted into said outlet stub, said bearing part having a bayonet mount for connecting said bearing part to said 90° elbow and having a upper and a lower bearing point for supporting said upper and said lower bearing surface, respectively.

* * * * *